US010001143B2

(12) United States Patent
Yoshida et al.

(10) Patent No.: US 10,001,143 B2
(45) Date of Patent: Jun. 19, 2018

(54) METHOD FOR ASSEMBLING COMPRESSOR, AND BUNDLE GUIDE DEVICE

(71) Applicant: MITSUBISHI HEAVY INDUSTRIES COMPRESSOR CORPORATION, Tokyo (JP)

(72) Inventors: Satoru Yoshida, Hiroshima (JP); Toru Yoshimune, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 328 days.

(21) Appl. No.: 14/769,369

(22) PCT Filed: Feb. 26, 2013

(86) PCT No.: PCT/JP2013/055003
§ 371 (c)(1),
(2) Date: Aug. 20, 2015

(87) PCT Pub. No.: WO2014/132342
PCT Pub. Date: Sep. 4, 2014

(65) Prior Publication Data

US 2016/0003263 A1 Jan. 7, 2016

(30) Foreign Application Priority Data

Feb. 26, 2013 (WO) ..... PCT/JP2013/055003

(51) Int. Cl.
*F04D 29/60* (2006.01)
*F04D 29/42* (2006.01)
(Continued)

(52) U.S. Cl.
CPC ..... *F04D 29/603* (2013.01); *F04D 17/10* (2013.01); *F04D 17/125* (2013.01);
(Continued)

(58) Field of Classification Search
CPC .... F04D 29/603; F04D 29/266; F04D 19/002; F04D 29/284; F04D 17/10; F04D 29/626;
(Continued)

(56) References Cited

U.S. PATENT DOCUMENTS 3,937,369 A 2/1976 Seals
3,937,589 A 2/1976 Remberg
(Continued)

FOREIGN PATENT DOCUMENTS

CN 101297120 A 10/2008
CN 102029514 A 4/2011
(Continued)

OTHER PUBLICATIONS

Extended European Search Report, dated Nov. 23, 2015, for European Application No. 13876110.1.
(Continued)

*Primary Examiner* — Ryan J Walters
*Assistant Examiner* — Lawrence Averick
(74) *Attorney, Agent, or Firm* — Birch, Stewart, Kolasch & Birch, LLP

(57) ABSTRACT

A method for assembling a compressor comprises: a bundle arrangement step in which a bundle is arranged behind the opening of a casing in the insertion direction; a first insertion step in which the front end of the bundle is inserted into the casing by moving the bundle by means of both an outside traveling device and an intermediate traveling device; and a second insertion step in which the intermediate traveling device is removed from the bundle and the bundle is inserted further inward into the casing by moving the bundle by means of both an inside traveling device and the outside traveling device.

5 Claims, 9 Drawing Sheets

(51) Int. Cl.

| | |
|---|---|
| ***F04D 29/62*** | (2006.01) |
| ***F04D 17/12*** | (2006.01) |
| ***F04D 17/10*** | (2006.01) |
| ***F04D 19/00*** | (2006.01) |
| ***F04D 29/26*** | (2006.01) |
| ***F04D 29/28*** | (2006.01) |
| ***F04D 29/32*** | (2006.01) |
| ***F04D 29/52*** | (2006.01) |
| ***F04D 29/64*** | (2006.01) |

(52) U.S. Cl.
CPC ..... *F04D 19/002* (2013.01); *F04D 29/266* (2013.01); *F04D 29/284* (2013.01); *F04D 29/321* (2013.01); *F04D 29/4206* (2013.01); *F04D 29/522* (2013.01); *F04D 29/624* (2013.01); *F04D 29/626* (2013.01); *F04D 29/646* (2013.01)

(58) Field of Classification Search
CPC .... F04D 29/522; F04D 29/646; F04D 29/321; F04D 17/125; F04D 29/624; F04D 29/4206
See application file for complete search history.

(56) References Cited

U.S. PATENT DOCUMENTS

| | | | | |
|---|---|---|---|---|
| 3,942,908 | A | 3/1976 | Pilarczyk | |
| 3,963,371 | A | 6/1976 | Sieghartner | |
| 4,050,660 | A | 9/1977 | Eggmann et al. | |
| 4,053,255 | A | 10/1977 | Taylor | |
| 4,098,558 | A | 7/1978 | Bush et al. | |
| 4,113,089 | A | 9/1978 | Bush et al. | |
| 4,116,583 | A | 9/1978 | Budris | |
| 4,218,181 | A | 8/1980 | Komatsu et al. | |
| 4,536,128 | A | 8/1985 | Feldle et al. | |
| 4,630,994 | A | 12/1986 | Gröss | |
| 5,522,701 | A | 6/1996 | Nicklas et al. | |
| 5,846,052 | A | 12/1998 | Kameda | |
| 5,971,702 | A | 10/1999 | Afton et al. | |
| 9,488,192 | B2 * | 11/2016 | Ota | F04D 29/4206 |
| 2003/0021681 | A1 | 1/2003 | Gregory | |
| 2009/0214332 | A1 | 8/2009 | Towsley et al. | |
| 2009/0246039 | A1 | 10/2009 | Haack et al. | |
| 2009/0288291 | A1 | 11/2009 | Ziekow et al. | |
| 2010/0275442 | A1 | 11/2010 | Ohl, Jr. | |
| 2011/0052426 | A1 * | 3/2011 | Borer | F04D 17/122 417/247 |
| 2012/0163962 | A1 | 6/2012 | Mariotti | |
| 2012/0243982 | A1 * | 9/2012 | Sasaki | F04D 17/122 415/200 |
| 2013/0243582 | A1 * | 9/2013 | Higashio | F04D 29/4206 415/182.1 |
| 2013/0266440 | A1 * | 10/2013 | Ota | F04D 29/4206 415/213.1 |
| 2015/0007435 | A1 * | 1/2015 | Yoshida | F04D 29/644 29/888.02 |
| 2015/0037147 | A1 * | 2/2015 | Okada | F04D 29/624 415/220 |
| 2015/0369249 | A1 * | 12/2015 | Yoshida | F04D 17/125 415/170.1 |

FOREIGN PATENT DOCUMENTS

| | | | | |
|---|---|---|---|---|
| EP | 0 101 915 | A2 | 3/1984 | |
| EP | 0101915 | A3 * | 5/1985 | F04D 29/426 |
| EP | 0 618 369 | A1 | 10/1994 | |
| EP | 0 766 007 | A1 | 4/1997 | |
| EP | 0 840 016 | A2 | 5/1998 | |
| EP | 1 158 178 | A2 | 11/2001 | |
| EP | 2 045 472 | A1 | 4/2009 | |
| EP | 2 400 161 | A2 | 12/2011 | |
| EP | 2 474 743 | A2 | 7/2012 | |
| EP | 2 479 437 | A2 | 7/2012 | |
| JP | 47-12527 | A | 6/1972 | |
| JP | 57-140598 | A | 8/1982 | |
| JP | 2-72400 | U | 6/1990 | |
| JP | 11-270499 | A | 10/1999 | |
| JP | 2000-38988 | A | 2/2000 | |
| JP | 2009-513863 | A | 4/2009 | |
| JP | 2011-220307 | A | 11/2011 | |
| JP | 2012-177331 | A | 11/2011 | |
| JP | 2012-177337 | A | 9/2012 | |
| JP | 2012177337 | A * | 9/2012 | F04D 29/4206 |
| JP | 2013-174164 | A | 9/2013 | |
| WO | 2007/048584 | A1 | 5/2007 | |
| WO | WO 2012/114655 | A1 | 8/2012 | |

OTHER PUBLICATIONS

International Search Report and Written Opinion of the International Searching Authority (Forms PCT/ISA/237 and PCT/ISA/210), dated May 21, 2013, for International Application No. PCT/JP2013/055003, with an English translation is attached.
Chinese Office Action and Chinese Search Report, dated May 27, 2016, for Chinese Application No. 201380070898.3, along with an English translation of the Chinese Search Report.

* cited by examiner

METHOD FOR ASSEMBLING COMPRESSOR, AND BUNDLE GUIDE DEVICE

TECHNICAL FIELD

The present invention relates to a method for assembling a compressor that guides a bundle into a casing, and a bundle guide device.

BACKGROUND ART

A vertically split compressor that inserts and removes a bundle which has a columnar shape and accommodates a rotor, a blade, and the like into and from a casing which has a tubular shape in an axial direction is known.

In the vertically split compressor, the inner peripheral surface of the casing or the like may be scratched when the inner peripheral surface of the casing comes into contact with the outer peripheral surface of the bundle during the insertion of the bundle into the casing. In a case where the inner peripheral surface of the casing is scratched, the problem that the airtightness of the bundle compressor is reduced arises.

A bundle guide device provided with a pair of left and right inside traveling devices that are arranged in a front portion of the bundle in the insertion direction, a truck that is arranged in a rear portion of the bundle in the insertion direction and is capable of height adjustment, and relative angle detection means for detecting the relative angular difference between the bundle and the casing has been proposed (for example, refer to PTL 1).

With this bundle guide device, it is possible to insert the bundle into the casing while frequently correcting the inclination angle of the bundle so that the relative angular difference between the axis of the bundle and the axis of the casing becomes a predetermined angular difference.

A through hole such as a suction nozzle is formed in a lower portion of the outer peripheral wall of the casing of the compressor described above. In some cases, this through-hole is arranged on the traveling line of an inside roller in the vicinity of an opening. Accordingly, the inside roller may be fitted into the through-hole formed in the lower portion of the outer peripheral wall and the bundle cannot be smoothly inserted in some cases when the inside roller is used immediately after the insertion of the front end of the bundle into the opening of the casing.

A method for inserting the bundle into the casing in a state where the center-of-gravity position of the bundle is lifted by a wire or the like until, for example, the inside roller crosses the through-hole in the casing in the axial direction is conceivable in order to prevent the inside roller from being fitted into the through-hole. In this case, the bundle can be smoothly inserted into the casing by using the inside roller and an outside roller on a side forward in the insertion direction from the position of the through-hole in the axial direction while preventing the inside roller from being fitted into the through-hole.

CITATION LIST

Patent Literature

[PTL 1] Japanese Unexamined Patent Application Publication No. 2011-220307

SUMMARY OF INVENTION

Technical Problem

In the method for assembling a compressor described above, however, the insertion into the casing needs to be performed in a state where the inside roller of the bundle is allowed to float from the inner peripheral surface of the casing, and thus a large crane apparatus that is capable of sufficiently supporting the bundle needs to be prepared. In a case where the bundle is lifted by the crane apparatus, alignment between the front end of the bundle and the opening of the casing in the insertion direction cannot be easily performed and an operator's skill is required for the alignment, and thus a long period of time is required for the operation.

An object of the present invention is to provide a method for assembling a compressor and a bundle guide device with which a bundle can be smoothly inserted into a casing even without an operator's skill and the length of time that is required for an operation for inserting the bundle into the casing can be shortened.

Solution to Problem

The following configuration is adopted to solve the problems described above.

According to a first aspect of the present invention, there is provided a method for assembling a compressor including a bundle having a rotor therein, a casing into which the bundle is inserted, and an inside traveling device supporting the front end of the bundle in the direction of the insertion into the casing and capable of traveling in the insertion direction on the inner peripheral surface of the casing, and an outside traveling device supporting the rear end of the bundle in the insertion direction and capable of traveling in the insertion direction on a base surface disposed outside the casing and an intermediate traveling device supporting the intermediate portion of the bundle between the inside traveling device and the outside traveling device in the insertion direction and capable of traveling on the base surface being removable from the compressor. The first aspect includes a bundle arrangement step in which the bundle is arranged behind an opening of the casing in the insertion direction and a first insertion step in which the front end of the bundle is inserted into the casing by moving the bundle by means of both the outside traveling device and the intermediate traveling device. The first step further includes a second insertion step in which the intermediate traveling device is removed from the bundle and the bundle is inserted further inward into the casing by moving the bundle by means of both the inside traveling device and the outside traveling device.

In the method for assembling a compressor according to a second aspect of the present invention corresponding to the method for assembling a compressor according to the first aspect described above, a center-of-gravity position moving step, in which the center-of-gravity position of the bundle in the insertion direction is moved to the rear end side, may be further provided between the bundle arrangement step and the first insertion step.

In the method for assembling a compressor according to a third aspect of the present invention corresponding to the method for assembling a compressor according to the second aspect described above, the center-of-gravity position may be moved to the rear end side in the center-of-gravity position moving step by attaching a counterweight to the outside traveling device.

According to a fourth aspect of the present invention, there is provided a bundle guide device for a compressor including a bundle having a rotor therein and a casing into which the bundle is inserted, the casing having a through-hole in a peripheral wall portion thereof, the bundle guide device including an inside traveling device supporting the front end of the bundle in the direction of the insertion into the casing and capable of traveling in the insertion direction on the inner peripheral surface of the casing. The bundle guide device further includes an outside traveling device supporting the rear end of the bundle in the insertion direction and capable of traveling in the insertion direction on a base surface disposed outside the casing and an intermediate traveling device supporting the intermediate portion of the bundle between the inside traveling device and the outside traveling device in the insertion direction and rolling on the base surface. The distance between the intermediate traveling device and the inside traveling device in the insertion direction is longer than the distance from an opening of the casing to the front edge of the through-hole in the insertion direction.

In the bundle guide device a fifth aspect of the present invention corresponding to the bundle guide device according to the fourth aspect described above, the intermediate roller and the outside roller may have a height adjusting mechanism adjusting the height of the bundle.

Advantageous Effects of Invention

According to the method for assembling a compressor and the bundle guide device according to the above-described aspects of the present invention, the bundle can be smoothly inserted into the casing even without an operator's skill and the length of time that is required for the operation for inserting the bundle into the casing can be shortened.

DESCRIPTION OF EMBODIMENTS

Hereinafter, a method for assembling a compressor and a bundle guide device according to an embodiment of the present invention will be described.

Figure 1:
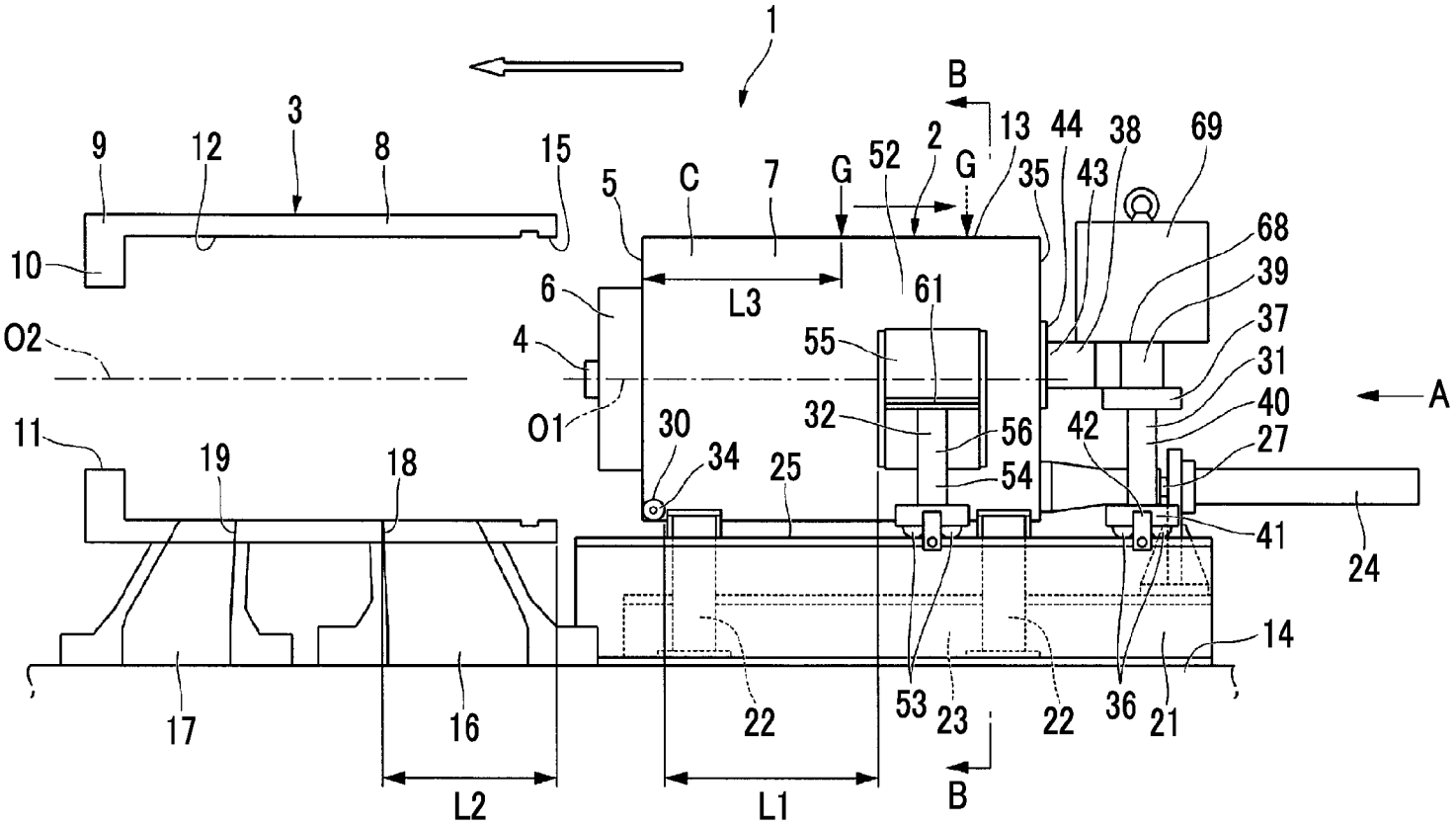
FIG. 1 is a side view illustrating a compressor and a bundle guide device according to an embodiment of the present invention.

FIG. 1 illustrates schematic configurations of the compressor and the bundle guide device according to this embodiment.

A compressor 1, which is a so-called vertically split compressor, is provided with a bundle 2 and a casing 3.

A rotor 4 and a stationary portion C that rotatably supports the rotor 4 are provided in the bundle 2. The bundle 2 is formed to have a columnar shape, more specifically, a circular columnar shape, about the axis O1 of the rotor 4. The bundle 2 is provided with a positioning protrusion 6 that protrudes forward in the insertion direction from the front end 5. The positioning protrusion 6 is formed into an annular shape, reduced in diameter compared to a main body section 7 of the bundle 2. In FIG. 1, the insertion direction of the bundle 2 is indicated by an arrow.

The casing 3 is a member into which the bundle 2 is inserted. The casing 3 is provided with an outer peripheral wall (peripheral wall portion) 8 that has a tubular shape and a bottom wall 10 that extends radially inward in the insertion direction from the front end 9 of the outer peripheral wall 8. A circular hole portion 11 is formed, about the axis O2 of the casing 3, in the central portion of the bottom wall 10. The hole portion 11 is formed to be slightly larger in diameter than the positioning protrusion 6 described above and the positioning protrusion 6 can be fitted thereinto. The inner peripheral surface 12 of the casing 3 and the outer peripheral surface 13 of the bundle 2 are slightly tapered (not illustrated) toward the front in the insertion direction. The diameter of the inner peripheral surface 12 of the casing 3 is slightly larger (for example, less than 1 mm) than the diameter of the outer peripheral surface 13, which faces the inner peripheral surface 12, of the bundle 2 in a state where the insertion into the casing 3 is completed.

The casing 3 is fixed onto a stand 14 for the direction of the axis O2 thereof to be the horizontal direction. The casing 3 is provided with an opening 15, for the insertion and removal of the bundle 2, on the side opposite to the bottom wall 10 in the direction of the axis O2. In addition, a suction nozzle 16 and a discharge nozzle 17 are provided under the outer peripheral wall 8 of the casing 3 in a state where the casing 3 is fixed to the stand 14. Each of the suction nozzle 16 and the discharge nozzle 17 is formed into a tubular shape, increasing in diameter downward. The suction nozzle 16 is arranged on the opening 15 side in the direction of the axis O2 compared to the discharge nozzle 17. The suction nozzle 16 and the discharge nozzle 17 are provided with respective through-holes 18 and 19 penetrating the outer peripheral wall 8.

Figure 2:
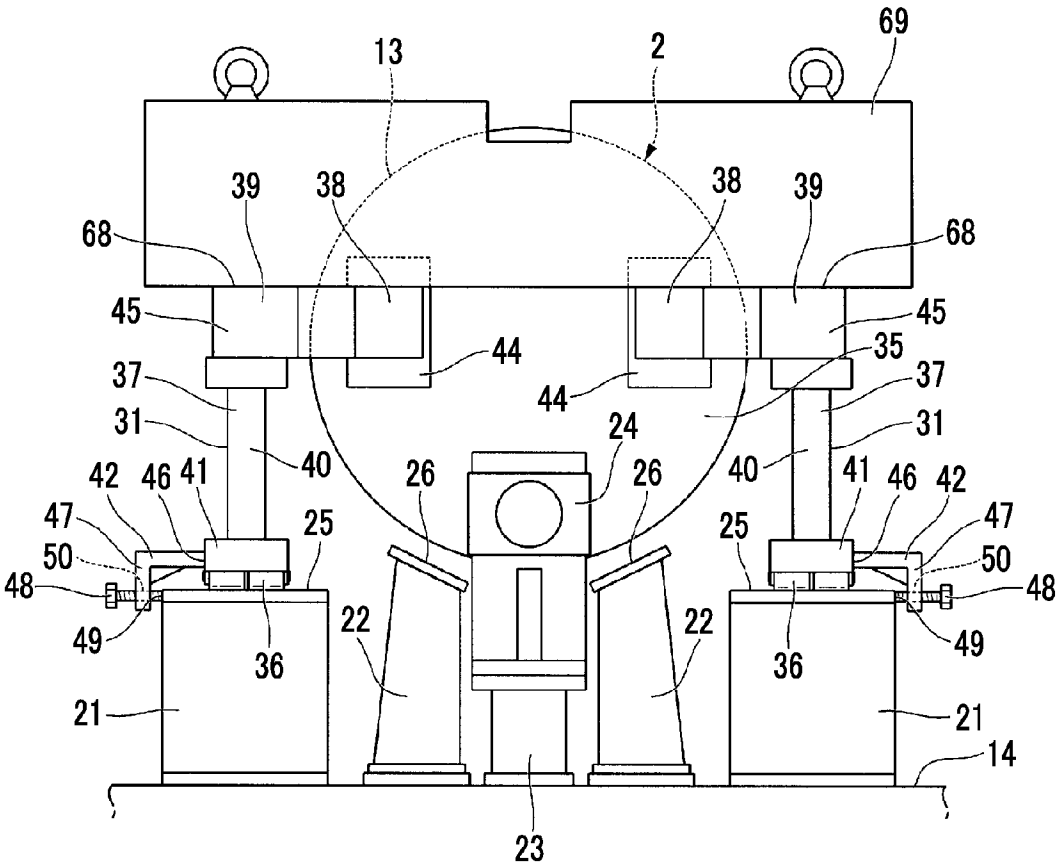
FIG. 2 is an arrow view of this embodiment seen in the A direction in FIG. 1.

As illustrated in FIGS. 1 and 2, the bundle guide device according to this embodiment is provided with a pair of rail members 21, a pair of receiving bases 22, a cylinder rail 23, and a cylinder 24.

The pair of rail members 21 are members that form a track for the insertion of the bundle 2 into the casing 3 outside the casing 3. These rail members 21 are laid on the stand 14 along a line extending from the axis O2 of the casing 3. In addition, the rail members 21 are laid to extend in a direction away from the opening 15 of the casing 3. The upper surfaces (base surfaces) 25 of the rail members 21 are horizontal surfaces. These rail members 21 extend in parallel to each other at a distance that is substantially equal to the diameter of the bundle 2.

The receiving bases 22 are members where the bundle is temporarily placed before the insertion into the casing 3. A plurality of the (for example, two) receiving bases 22 are disposed, in a state of being separated in the direction of the axis O1 of the bundle 2, on the stand 14 inside the track of the pair of rail members 21. These receiving bases 22 have inclined surfaces 26, which face the outer peripheral surface 13 of the bundle 2, in respective upper portions. These inclined surfaces 26 are inclined downward toward the width-direction center of the track formed by the rail members 21.

The cylinder 24 is a device for pressing the bundle to the casing 3 side. The cylinder 24 uses fluid pressure such as hydraulic pressure so that an inner rod 27 (refer to FIG. 1) is stretchable.

The cylinder rail 23 is a rail for supporting the cylinder 24. The cylinder rail 23 is laid along the rail members 21 on the stand 14 inside the track of the rail members 21. Fixing units (not illustrated) that are capable of removably supporting the cylinder 24 are provided at a plurality of longitudinal-direction locations of the cylinder rail 23. Since the cylinder rail 23 is provided with the plurality of fixing units as described above, the cylinder 24 can be moved in the longitudinal direction of the rail members 21 in accordance with the position of the bundle 2 during the insertion. In other words, the bundle 2 can be pressed toward the casing 3 and then accommodated, even in a case where the distance of the movement of the bundle 2 exceeds the stroke amount of the inner rod 27, by pressing the bundle 2 while gradually moving the position of the cylinder 24 to the casing 3 side.

In addition, the bundle guide device according to this embodiment is provided with a pair of inside traveling devices 30, a pair of outside traveling devices 31, and a pair of intermediate traveling devices 32.

The inside traveling devices 30 are provided with inside rollers 34 that support the front end 5 of the bundle 2 in the insertion direction and are capable of rolling on the inner peripheral surface 12 of the casing 3 in the insertion direction of the bundle 2. The inside rollers 34, which are cylindrical roller members, are rotatably supported by a bearing section (not illustrated) that is disposed at a lower edge of the front end 5 of the bundle 2. Each of the inside rollers 34 is attached to slightly protrude radially outside from the outer peripheral surface 13 of the front end 5 of the bundle 2. Each of the pair of inside rollers 34 is arranged, separated in the circumferential direction, in the lower half portion of the bundle 2. In addition, viewed in the direction of the axis O1, the pair of inside rollers 34 are arranged at positions symmetrical to each other with the meridian of the bundle 2 being the axis of symmetry. Since the inside traveling devices 30 are disposed in this manner, the bundle 2 can be pushed into the bottom wall 10 side of the casing 3 without the front end 5 of the bundle 2 interfering with the inner peripheral surface 12 of the casing 3. Likewise, the front end 5 can be moved to the opening 15 of the casing 3 without the front end 5 of the bundle 2 interfering with the inner peripheral surface 12 of the casing 3 when the bundle 2 is drawn out of the casing 3 for maintenance or the like.

The pair of outside traveling devices 31 are devices that support the rear end 35 of the bundle 2 in the insertion direction to be capable of traveling. The outside traveling devices 31 are provided with outside rollers 36 and rear leg members 37.

The outside rollers 36 are roller members that are capable of rolling on the upper surfaces 25 of the rail members 21, which are disposed outside the casing 3, in the insertion direction of the bundle 2.

The rear leg members 37, which are removable from the rear end 35 of the bundle 2, rotatably support the outside rollers 36. The rear leg members 37 are provided with rear extending portions 38, horizontal extending portions 39, rear jack portions 40, rear roller support units 41, and rear leveling adjustment mechanism sections 42.

The rear extending portions 38 are formed to extend rearward in the insertion direction of the bundle 2. Flanged portions 44 that can be fixed to the rear end 35 of the bundle 2 are provided at the front ends 43 of the rear extending portions 38. The flanged portions 44 are removably fastened to the rear end 35 of the bundle 2 by using bolts or the like.

The horizontal extending portions 39 are formed to extend in the horizontal direction from the backs of the rear extending portions 38 to positions vertically upward from the rail members 21.

The rear jack portions 40 are, for example, hydraulic jacks that are capable of lifting the rear end of the bundle 2. The rear jack portions 40 are arranged between the respective outer ends 45 of the horizontal extending portions 39 and the respective rear roller support units 41.

The rear roller support units 41 are frames that pivotally support the outside rollers 36, and the rear leveling adjustment mechanism sections 42 are attached to the outer surfaces 46 thereof.

The rear leveling adjustment mechanism sections 42 are mechanisms that adjust the horizontal-direction position of the rear end 35 of the bundle 2 by adjusting the horizontal-direction positions of the outside traveling devices 31. The rear leveling adjustment mechanism sections 42 are provided with arm members 47 and position adjusting bolts 48.

The arm members 47, which are supported by the outer surfaces 46 of the rear roller support units 41, are formed into an L shape to go around outside the track of the rail members 21. The arm members 47 have screw holes 50 at positions facing the outer surfaces 49 of the rail members 21.

The position adjusting bolts 48 are members that press the respective outer surfaces 49 of the rail members 21 from the outside of the track toward the inside of the track. The position adjusting bolts 48, which are screwed into the screw holes 50 from the outside of the track, are capable of pressing the outer surfaces 49 of the rail members 21 from both outer sides of the track in accordance with the amount of screwing into the screw holes 50.

The rear leveling adjustment mechanism sections 42 allows the amount of screwing of the respective position adjusting bolts 48 to be adjusted and any one of the outer surfaces 49 of the pair of rail members 21 to be pressed, and thus the outside traveling devices 31 can be moved to any one side in the left-right direction of the track by using the reaction force. As a result, the horizontal-direction position of the rear end 35 of the bundle 2 with respect to the casing 3 can be adjusted.

The pair of intermediate traveling devices 32 support the intermediate portion 52 of the bundle between the front end 5 supported by the inside traveling devices 30 and the rear end 35 supported by the outside traveling devices 31 in the insertion direction of the bundle 2. The pair of intermediate traveling devices 32 are provided with intermediate rollers 53 and intermediate leg members 54.

As is the case with the outside rollers 36, the intermediate rollers 53 are roller members that are capable of rolling on the respective upper surfaces 25 of the rail members 21 in the longitudinal direction of the rail members 21.

The intermediate leg members 54, which are removable from the outer peripheral surface 13 of the intermediate portion 52 of the bundle 2, rotatably support the intermediate rollers 53. The intermediate leg members 54 are provided with attachment bracket portions 55, intermediate jack portions 56, intermediate roller support units 57, and intermediate leveling adjustment mechanism sections 58.

The attachment bracket portions 55 are provided with fastening portions 59 and extending portions 60. The fastening portions 59 are curved along the outer peripheral surface 13 of the bundle 2 and are removable from the intermediate portion 52 of the bundle 2 by using bolts or the like. The extending portions 60 are formed to extend radially outward from the bundle 2 from the fastening portions 59 and are provided with attachment seats 61 to which the upper ends of the intermediate jack portions 56 are fixed.

As is the case with the rear jack portions 40, the intermediate jack portions 56 are, for example, hydraulic jacks that are capable of lifting the intermediate portion 52 of the bundle 2. These intermediate jack portions 56 are arranged between the respective attachment seats 61 of the attachment bracket portions 55 and the respective intermediate roller support units 57.

As is the case with the rear leveling adjustment mechanism sections 42 described above, the intermediate leveling adjustment mechanism sections 58 are provided with arm members 63 that are supported by the outer surfaces 62 of the intermediate roller support units 57 and are formed to go around outside the track of the rail members 21. The arm members 63 have screw holes 65 at positions facing the outer surfaces 64 of the rail members 21. Position adjusting bolts 66 are screwed into the screw holes 65 from the outside of the track, and ends of the position adjusting bolts 66 protrude to the rail member 21 sides. In other words, as is the case with the rear leveling adjustment mechanism sections 42 described above, the position of the intermediate portion 52 of the bundle 2 with respect to the casing 3, specifically, the position in the horizontal direction that is orthogonal to the insertion direction, can be adjusted by adjusting the amount of screwing of the respective position adjusting bolts 66 of the intermediate leveling adjustment mechanism sections 58.

As illustrated in FIG. 1, the intermediate traveling devices 32 are arranged for the distance L1 from the inside traveling devices 30 to the intermediate traveling devices 32 to be slightly longer than the distance L2 from the end of the casing 3 on the opening 15 side to the front edge of the through-hole 18 in the insertion direction of the bundle 2. When this arrangement is used, the bundle 2 can be supported by the intermediate traveling devices 32 and the outside traveling devices 31 to be capable of traveling until the inside rollers 34 of the inside traveling devices 30 cross the through-hole 18 in the insertion direction during the insertion of the bundle 2 into the casing 3. In other words, a state where the front end 5 of the bundle 2 is not supported by the inside traveling devices 30 can be achieved even after the insertion of the inside traveling devices 30 into the casing 3. Accordingly, hindrance to the movement of the bundle 2 in the insertion direction attributable to the inside rollers 34 being fitted into the through-hole 18 can be prevented in a case where the through-hole 18 of the suction nozzle 16 of the casing 3 described above is arranged on the traveling path of the inside rollers 34.

As illustrated in FIGS. 1 and 2, the outside traveling devices 31 described above are provided with counterweight installation units 68 in upper portions of the rear extending portions 38 and the horizontal extending portions 39. The counterweight installation units 68 are provided with horizontal surfaces. Counterweights 69 can be placed at the counterweight installation units 68 for the purpose of moving the center-of-gravity position G of the bundle 2 to the rear end 35 side. Herein, the center-of-gravity position G that is illustrated in FIG. 1 is a center-of-gravity position prior to the attachment of the counterweight 69 to the outside traveling devices 31.

The counterweight 69 described above is attached to the outside traveling devices 31 mainly in a case where the intermediate traveling devices 32 need to be arranged on the rear end 35 side compared to the center-of-gravity position G of the bundle 2 in the insertion direction. Herein, examples of the case where the intermediate traveling devices 32 need to be arranged on the rear end side compared to the center-of-gravity position G include a case where the distance L1 from the end of the casing 3 on the opening 15 side to the front edge of the through-hole 18 is longer than the distance L3 from the inside traveling devices 30 to the center-of-gravity position G in the insertion direction.

The center-of-gravity position G of the bundle 2 can be temporarily moved to the rear end 35 side since the weight of the rear end 35 of the bundle 2 can be increased by using the counterweight 69. In this manner, the bundle can be supported, to be capable of traveling, by the intermediate traveling devices 32 and the outside traveling devices 31 without having to support the bundle 2 by using the inside traveling devices 30. In this case, the center-of-gravity position G of the bundle 2 is moved to a space between the intermediate traveling devices 32 and the outside traveling devices 31, and thus it is possible to prevent the bundle 2 from collapsing forward in the insertion direction.

The counterweight 69 is formed, for example, to have a length that allows the counterweight 69 to be placed across the counterweight installation units 68 of the pair of rear leg members 37. Accordingly, linearity impairment such as an oblique motion of the bundle 2 during the insertion into the casing 3 due to deviation in the center-of-gravity position of the bundle 2 in the width direction of the track of the rail members 21 or the like can be prevented. Although a case where the counterweight 69 is placed across the counterweight installation units 68 of the pair of rear leg members 37 has been described as an example, a plurality of the counterweights may be disposed and these counterweights may be individually attached to the respective rear leg members. In this case, it is desirable that the counterweights 69 placed in the respective counterweight installation units 68 have the same weight. In addition, positions of the rear leg members 37 to which the counterweight 69 is attached are not limited to upper portions of the rear leg members 37. In the case of a configuration in which the counterweight 69 is placed in the upper portions of the rear leg members 37 as described above, the center-of-gravity position G of the bundle 2 can be moved to the rear end 35 side with the installation of the counterweight 69 facilitated by the use of a crane apparatus or the like.

Next, the method for assembling the compressor 1 described above will be described with reference to the flowchart in FIG. 9 and FIGS. 1 to 8.

Figure 4:
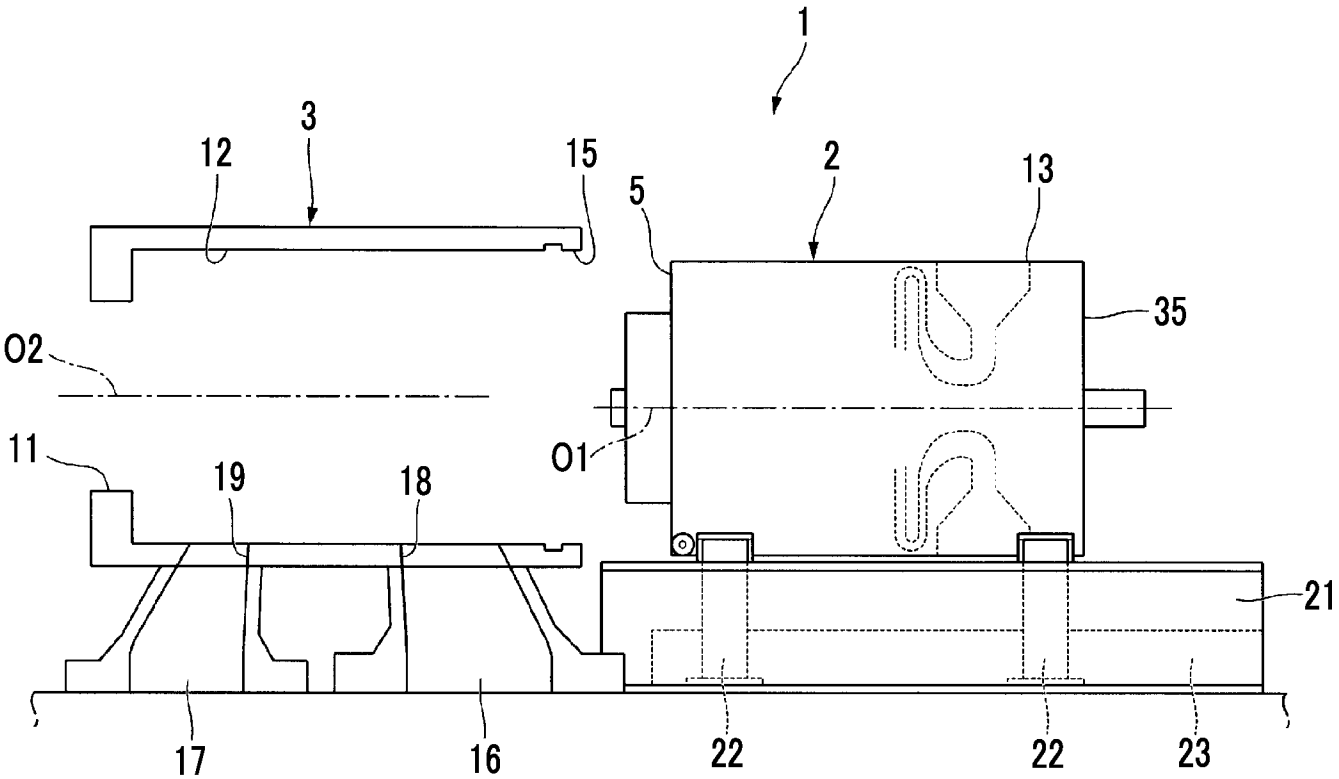
FIG. 4 is a side view of this embodiment corresponding to FIG. 1, on which a rear traveling device and an intermediate traveling device have yet to be mounted.
Figure 5:
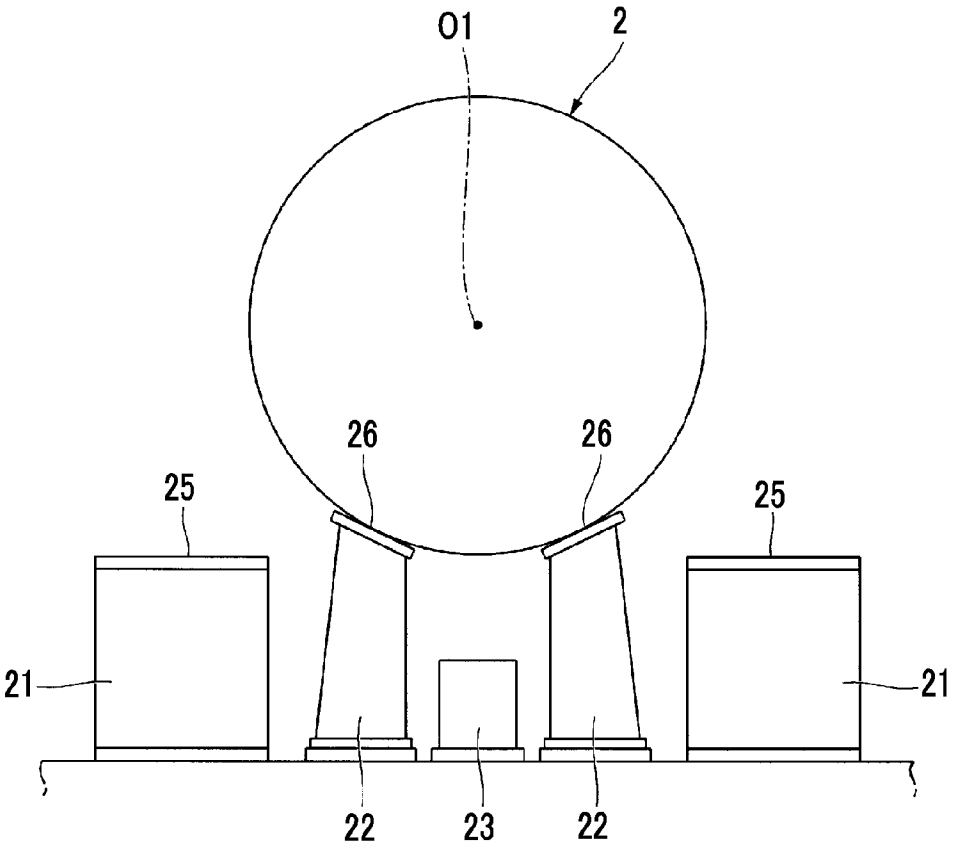
FIG. 5 is an arrow view of this embodiment corresponding to FIG. 2, on which the rear traveling device and the intermediate traveling device have yet to be mounted.

Firstly, a bundle arrangement step is carried out (Step S01) in which the bundle 2 is arranged behind the opening 15 of the casing 3 in the insertion direction. In this bundle arrangement step, the bundle 2 is installed on the receiving bases 22 for the axis O1 to be in the insertion direction as illustrated in FIGS. 4 and 5. In addition, each of the intermediate leg members 54 and the rear leg members 37 is attached to the bundle 2 in the bundle arrangement step so that the intermediate rollers 53 and the outside rollers 36 are arranged on the upper surfaces 25 of the rail members 21.

Figure 3:
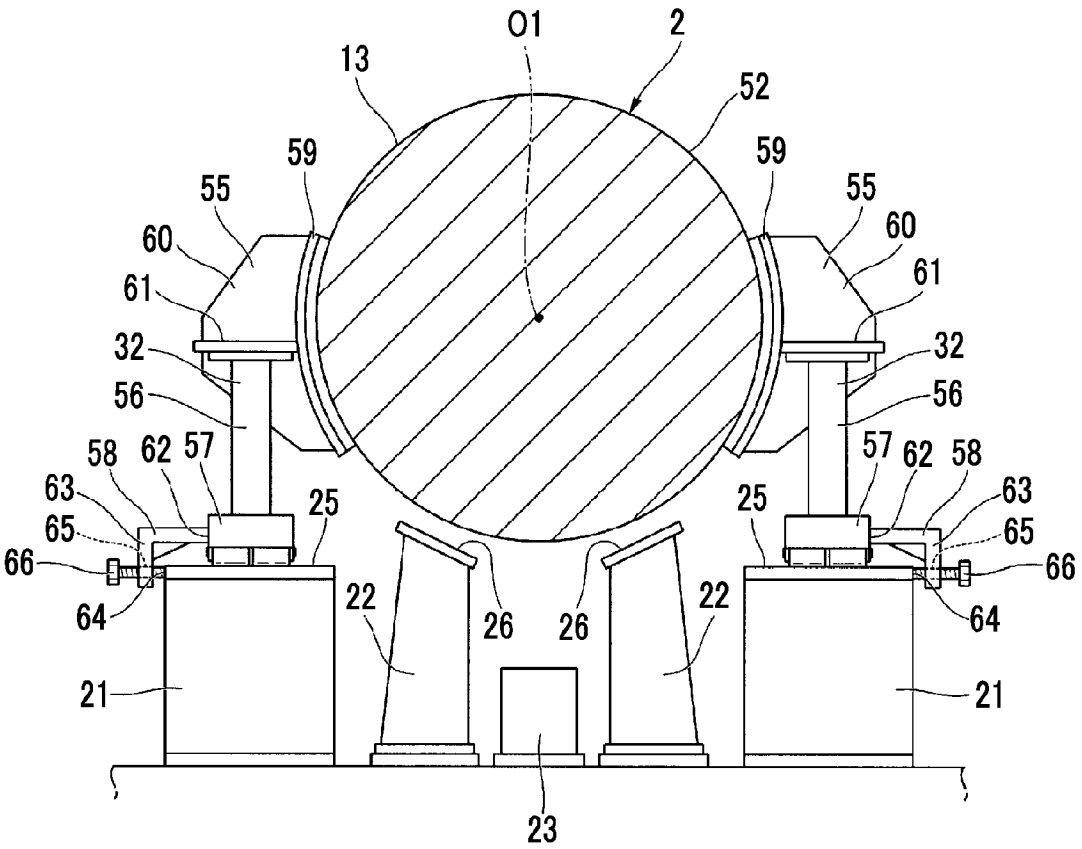
FIG. 3 is a sectional view of this embodiment taken along line B-B in FIG. 1.

In the bundle arrangement step, the height position of the bundle 2 is also raised by the rear jack portions 40 and the intermediate jack portions 56 as illustrated in FIG. 3 and the height positions of the axis O1 of the bundle 2 and the axis O2 of the casing 3 are adjusted to match each other. As the height position of the bundle 2 is adjusted by using the rear jack portions 40 and the intermediate jack portions 56 as described above, the state of the bundle 2 is changed from a state where the bundle 2 is supported by the receiving bases 22 to a state where the bundle 2 is supported by the intermediate traveling devices 32 and the outside traveling devices 31.

In the bundle arrangement step, the horizontal-direction positions of the axis O1 of the bundle 2 and the axis O2 of the casing 3 are also adjusted to match each other by the rear leveling adjustment mechanism sections and the intermediate leveling adjustment mechanism sections 58. In addition, the cylinder 24 is attached to the cylinder rail 23 and a state where the rear end 35 of the bundle 2 can be pressed by the cylinder 24 is achieved in the bundle arrangement step.

Then, a center-of-gravity position moving step is performed (Step S02) in a case where the position where the bundle 2 is supported by the intermediate traveling devices 32 is on the rear end 35 side compared to the center-of-gravity position G in the insertion direction. More specifically, the counterweight 69 is lifted by the crane apparatus (not illustrated) or the like and is placed across the counterweight installation units 68. This center-of-gravity position moving step may be omitted in a case where the center-of-gravity position G is arranged sufficiently on the rear end 35 side compared to the intermediate traveling devices 32.

Figure 6:
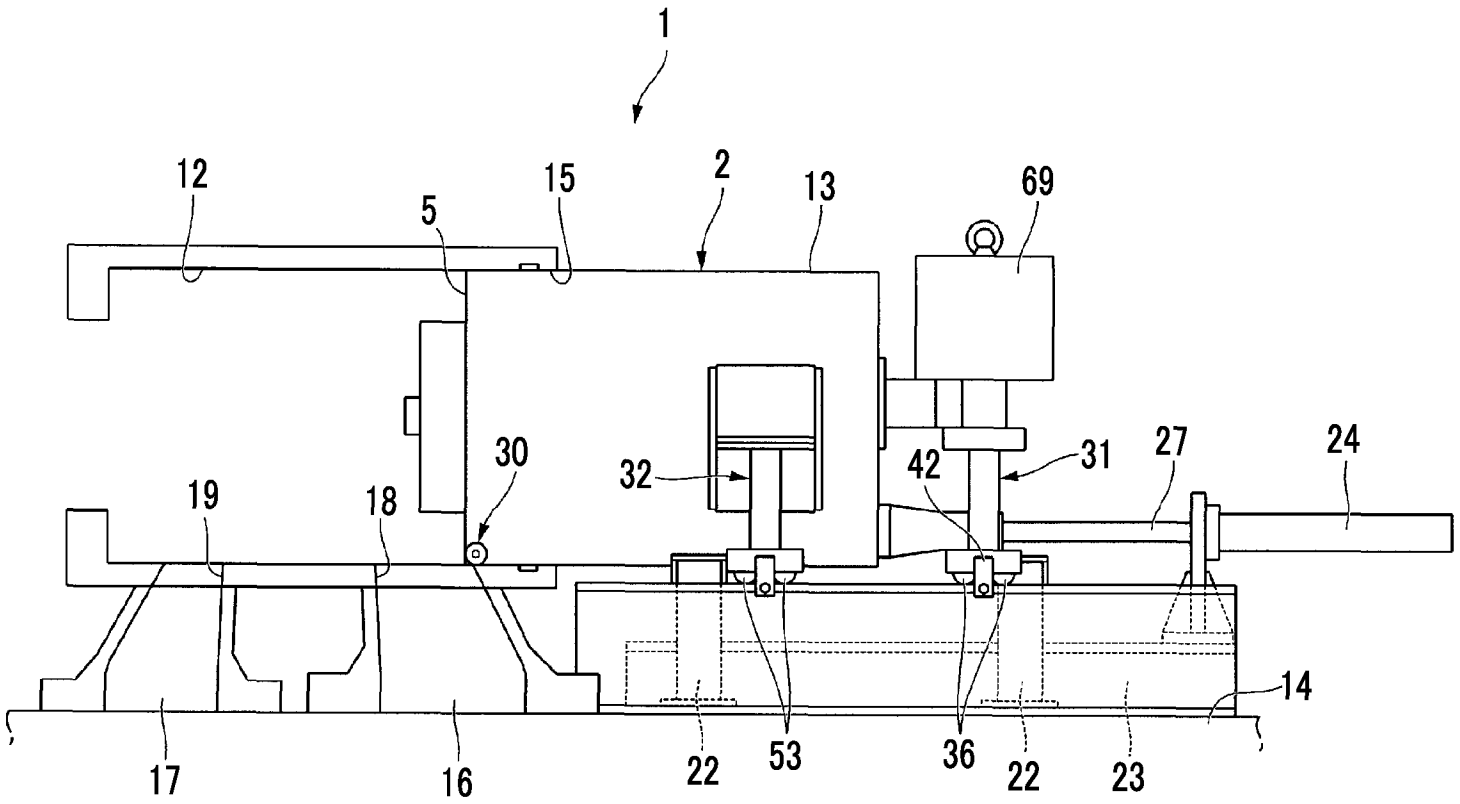
FIG. 6 is a side view of this embodiment corresponding to FIG. 1, which illustrates a state during a first insertion step.
Figure 7:
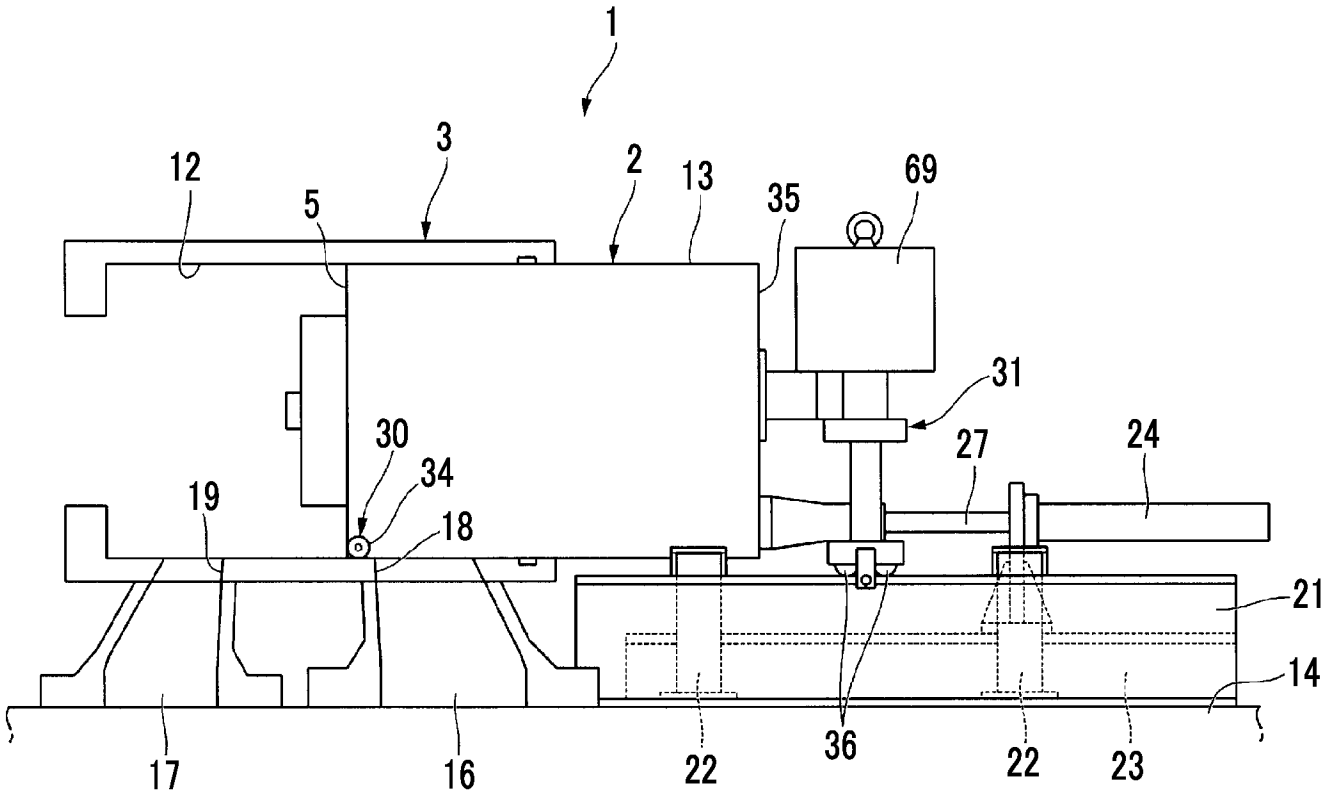
FIG. 7 is a side view of this embodiment corresponding to FIG. 1, which illustrates a state immediately prior to the initiation of a second insertion step.

Next, a first insertion step is performed (Step S03) in which the outside rollers 36 and the intermediate rollers 53 are allowed to roll so that the front end 5 of the bundle 2 is inserted into the casing 3. More specifically, the cylinder 24 is operated, the rear end 35 of the bundle 2 is pressed, and the outside rollers 36 and the intermediate rollers 53 are allowed to roll in the insertion direction, that is, the longitudinal direction of the rail members 21, as illustrated in FIG. 6 so that the bundle is moved to the casing 3 side. In a case where deviation occurs between the axis O1 of the bundle 2 and the axis O1 of the casing 3 during the course of this movement, the pressing of the bundle 2 by the cylinder 24 is stopped. Then, the front, back, left, and right positions of the bundle 2 and the insertion angle of the bundle 2 with respect to the casing 3 are adjusted by using the rear jack portions 40, the intermediate jack portions 56, the rear leveling adjustment mechanism sections 42, the intermediate leveling adjustment mechanism sections 58, and the like. Then, the insertion of the bundle 2 is temporarily stopped at the position available immediately after the inside rollers 34 of the bundle 2 cross the through-hole 18 in the insertion direction, as illustrated in FIG. 7, in the first insertion step.

Then, a second insertion step is performed in which the bundle 2 is completely accommodated in the casing 3. More specifically, the intermediate traveling devices 32 are removed from the bundle 2, as illustrated in FIG. 7, in the second insertion step. In other words, the height dimensions of the intermediate jack portions 56 are reduced and the bolts fixing the attachment bracket portions 55 of the intermediate leg members 54 are loosened so that the attachment bracket portions 55 are disassembled from the outer peripheral surface 13 of the bundle 2. In this manner, the load of the bundle 2 is applied to the inside rollers 34, and then the inside rollers 34 can roll on the inner peripheral surface 12 of the casing 3. In other words, a state is achieved where the inside traveling devices 30 and the outside traveling devices 31 support the bundle 2 to be capable of traveling.

In a case where the through-hole 18 is not arranged on the traveling path of the inside rollers 34 herein, the second insertion step may be performed at the point in time when the inside rollers 34 are inserted into the casing 3. In other words, the inside traveling devices 30 may be allowed to travel from the site on the inner peripheral surface 12 that is the closest to the opening 15 of the casing 3.

Then, the arrangement of the cylinder 24 is shifted to the casing 3 side, and the rear end 35 of the bundle 2 is pressed by the cylinder 24 as in the first insertion step. Then, the inside rollers 34 and the outside rollers are allowed to roll, and the bundle 2 is inserted further into the casing 3.

Figure 8:
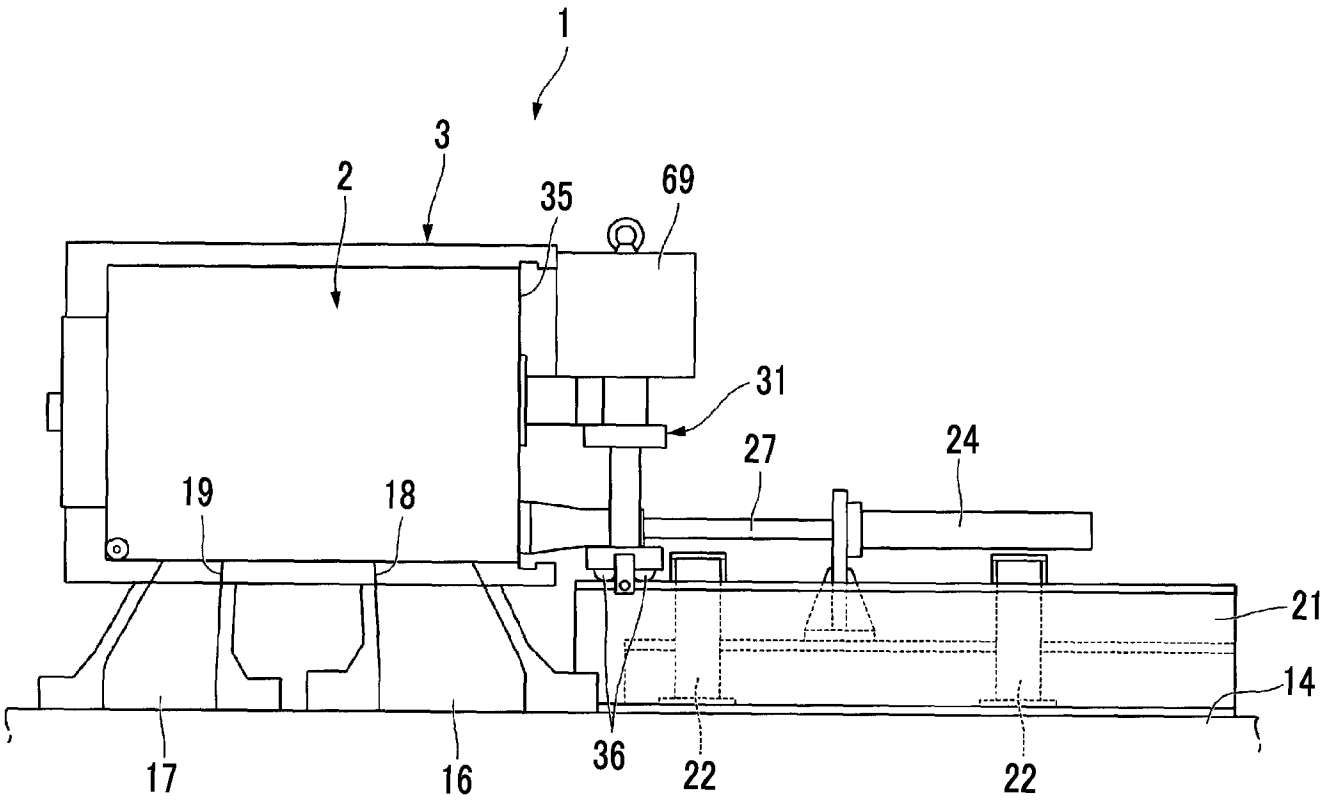
FIG. 8 is a side view of this embodiment corresponding to FIG. 1, which illustrates a state where the insertion of a bundle into a casing is completed.
Figure 9:
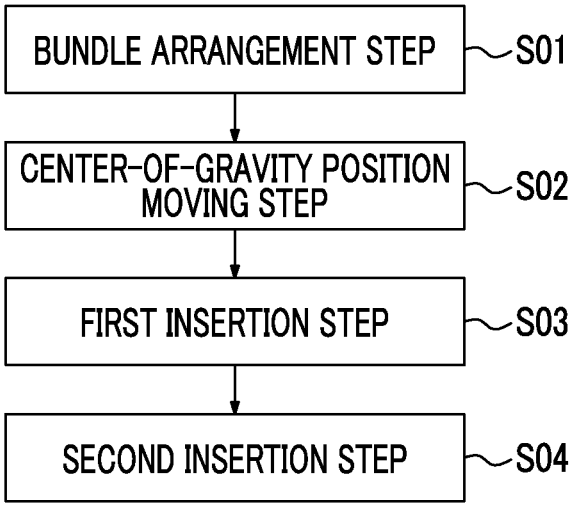
FIG. 9 is a flowchart illustrating each step of a bundle assembly method according to this embodiment.

A series of the above-described steps for assembling the compressor is terminated when the pressing of the bundle 2 by the cylinder 24 is stopped at the point in time when the bundle 2 is completely accommodated in the casing 3 as illustrated in FIG. 8 and the counterweight 69 and the outside traveling devices 31 are removed in order. The rail members 21, the receiving bases 22, and the cylinder rail 23 may be removed as well. The steps described above may be performed in reverse order when the bundle 2 is drawn out of the casing 3. Accordingly, detailed description of the procedure for drawing the bundle 2 out of the casing 3 will be omitted herein.

According to the embodiment described above, the bundle 2 can be supported by the intermediate traveling devices 32 and the outside traveling devices 31 when the bundle 2 is inserted into the casing 3. In addition, the inside traveling devices 30 allow the bundle 2 to travel on the inner peripheral surface 12 of the casing 3 after the front end 5 of the bundle 2 is inserted into the casing 3, and thus interference between the inner peripheral surface 12 of the casing 3 and the front end 5 of the bundle 2 on the front side in the insertion direction can be reliably avoided. As a result, the bundle 2 can be smoothly inserted into the casing 3 even without an operator's skill and the length of time that is required for the operation for inserting the bundle 2 into the casing 3 can be shortened.

In a case where the through-hole 18 or the like of the suction nozzle 16 is formed on the traveling path of the inside traveling devices 30, the intermediate traveling devices 32 and the outside traveling devices 31 can continue to support the bundle 2 until the inside traveling devices 30 of the bundle 2 cross the through-hole 18 of the suction nozzle 16 or the like. Accordingly, hindrance to the insertion of the bundle 2 attributable to the inside traveling devices 30 being fitted into the through-hole 18 can be prevented. On the insertion-direction side forward from the position where the inside traveling devices 30 cross the through-hole 18, the intermediate traveling devices 32 can be removed and the bundle 2 can be supported, to be capable of traveling, by the inside traveling devices 30 and the outside traveling devices 31.

In addition, the bundle 2 can be moved in the horizontal direction orthogonal to the insertion direction and the height direction by the rear jack portions 40, the intermediate jack portions 56, the rear leveling adjustment mechanism sections 42, and the intermediate leveling adjustment mechanism sections 58, and thus the adjustment of the position and the angle of the bundle 2 can be performed with ease.

In addition, the center-of-gravity position G of the bundle 2 can be moved to the rear end 35 side by the counterweight 69 in a case where the intermediate traveling devices 32 are attached on the rear end 35 side compared to the center-of-gravity position G of the bundle in the insertion direction. Accordingly, the center-of-gravity position G of the bundle 2 in the insertion direction can be arranged between the intermediate traveling devices 32 and the outside traveling devices 31. As a result, the bundle 2 can be stably moved in the insertion direction by the intermediate traveling devices 32 and the outside traveling devices 31 without having to support the front end 5 side of the bundle 2 by using the crane apparatus or the like.

The present invention is not limited to the embodiment described above. The present invention includes various modifications of the embodiment described above insofar as the modifications do not depart from the spirit of the present invention. In other words, the specific shapes, configuration, and the like of the embodiment are merely examples that can be appropriately changed.

For example, a case where the rear end 35 of the bundle 2 is pressed from behind in the insertion direction by the use of the cylinder 24 has been described in the embodiment described above, but the bundle 2 may be pressed to the casing 3 side by the use of a pressing mechanism other than the cylinder 24.

In addition, the shape of the bundle 2 is not limited to a circular columnar shape although a case where the bundle 2 has a circular columnar shape has been described in the embodiment described above. Likewise, the shape of the casing 3 is not limited to a cylindrical shape although a case where the casing 3 has a cylindrical shape has been described in the embodiment described above.

In addition, a case where the intermediate traveling devices 32 are arranged at one location between the inside traveling devices 30 and the outside traveling devices 31 in the insertion direction has been described in the embodiment described above, but the intermediate traveling devices 32 may be disposed at a plurality of locations.

In addition, a case where the counterweight 69 is removed from the counterweight installation units 68 at a timing immediately preceding the removal of the outside traveling devices 31 has been described in the embodiment described above, but the timing is not limited thereto. For example, the counterweight 69 may be removed at a timing when the intermediate traveling devices 32 are already removed. In this case, the combined mass of the objects pressed and moved by the cylinder 24 can be decreased. Accordingly, the amount of the energy that is consumed when the bundle 2 is pressed by the cylinder 24 can be reduced.

INDUSTRIAL APPLICABILITY

The present invention can be widely applied to vertically split compressors that are capable of inserting a bundle into a casing in an axial direction.

REFERENCE SIGNS LIST

1 Compressor
2 Bundle
3 Casing
4 Rotor
5 Front end
6 Positioning protrusion
7 Main body section
8 Outer peripheral wall
9 Front end
10 Bottom wall
11 Hole portion
12 Inner peripheral surface
13 Outer peripheral surface
14 Stand
15 Opening
16 Suction nozzle
17 Discharge nozzle
18 Through-hole
19 Through-hole
21 Rail member
22 Receiving base
23 Cylinder rail
24 Cylinder
25 Upper surface
26 Inclined surface
27 Inner rod
30 Inside traveling device
31 Outside traveling device
32 Intermediate traveling device
34 Inside roller
35 Rear end
36 Outside roller
37 Rear leg member
38 Rear extending portion
39 Horizontal extending portion
40 Rear jack portion
41 Rear roller support unit
42 Rear leveling adjustment mechanism section
43 Front end
44 Flanged portion
45 Outer end
47 Arm member
48 Position adjusting bolt
49 Outer surface
50 Screw hole
52 Intermediate portion
53 Intermediate roller
54 Intermediate leg member
55 Attachment bracket portion
56 Intermediate jack portion
57 Intermediate roller support unit
58 Intermediate leveling adjustment mechanism section
59 Fastening portion
60 Extending portion
61 Attachment seat
62 Outer surface
63 Arm member
64 Outer surface
65 Screw hole
66 Position adjusting bolt
68 Counterweight installation unit
69 Counterweight
O1 Axis
O2 Axis

The invention claimed is:

1. A method for assembling a compressor including a bundle having a rotor therein, a casing into which the bundle is inserted, and an inside traveling device supporting the front end of the bundle in the direction of the insertion into the casing and capable of traveling in the insertion direction on the inner peripheral surface of the casing, and an outside traveling device supporting the rear end of the bundle in the insertion direction and capable of traveling in the insertion direction on a base surface disposed outside the casing and an intermediate traveling device supporting the intermediate portion of the bundle between the inside traveling device and the outside traveling device in the insertion direction and capable of traveling on the base surface being removable from the compressor, comprising:

a bundle arrangement step in which the bundle is arranged behind an opening of the casing in the insertion direction;

a first insertion step in which the front end of the bundle is inserted into the casing by moving the bundle by means of both the outside traveling device and the intermediate traveling device;

a second insertion step in which the intermediate traveling device is removed from the bundle and the bundle is inserted further inward into the casing by moving the bundle by means of both the inside traveling device and the outside traveling device; and wherein when the intermediate traveling device supports the intermediate portion of the bundle between the inside traveling device and the outside traveling device, the distance from the intermediate traveling device to the inside traveling device in the insertion direction is longer than the distance from an opening of the casing to the front edge of a through-hole in a peripheral wall portion of the casing in the insertion direction of the bundle.

2. The method for assembling a compressor according to claim 1, further comprising a center-of-gravity position moving step, in which the center-of-gravity position of the bundle in the insertion direction is moved to the rear end side, between the bundle arrangement step and the first insertion step.

3. The method for assembling a compressor according to claim 2, wherein the center-of-gravity position is moved to the rear end side in the center-of-gravity position moving step by attaching a counterweight to the outside traveling device.

4. A bundle guide device for a compressor including a bundle having a rotor therein and a casing into which the bundle is inserted, the casing having a through-hole in a peripheral wall portion thereof, comprising:

an inside traveling device supporting the front end of the bundle in the direction of the insertion into the casing and capable of traveling in the insertion direction on the inner peripheral surface of the casing;

an outside traveling device supporting the rear end of the bundle in the insertion direction and capable of traveling in the insertion direction on a base surface disposed outside the casing, and an intermediate traveling device supporting the intermediate portion of the bundle between the inside traveling device and the outside traveling device in the insertion direction and rolling on the base surface, wherein the distance between the intermediate traveling device and the inside traveling device in the insertion direction is longer than the distance from an opening of the casing to the front edge of the through-hole in the insertion direction.

5. The bundle guide device according to claim 4, wherein the intermediate traveling device and the outside traveling device have a height adjusting mechanism adjusting the height of the bundle.

* * * * *